US011630413B2

(12) United States Patent
Iseno

(10) Patent No.: US 11,630,413 B2
(45) Date of Patent: Apr. 18, 2023

(54) IMAGE FORMING APPARATUS WITH DETACHABLE TONER CONVEYING PASSAGE

(71) Applicant: CANON KABUSHIKI KAISHA, Tokyo (JP)

(72) Inventor: Toshiya Iseno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/674,526

(22) Filed: Feb. 17, 2022

(65) Prior Publication Data

US 2022/0291623 A1 Sep. 15, 2022

(30) Foreign Application Priority Data

Mar. 15, 2021 (JP) ..... JP2021-041914

(51) Int. Cl.

| | |
|---|---|
| ***G03G 15/00*** | (2006.01) |
| ***G03G 21/00*** | (2006.01) |
| ***G03G 21/12*** | (2006.01) |
| ***G03G 21/10*** | (2006.01) |
| ***G03G 21/16*** | (2006.01) |

(52) U.S. Cl.

CPC ..... *G03G 21/105* (2013.01); *G03G 21/12* (2013.01); *G03G 21/1676* (2013.01)

(58) Field of Classification Search

CPC ..... G03G 21/10; G03G 21/105; G03G 21/12; G03G 21/169; G03G 21/16; G03G 21/1604; G03G 21/1619; G03G 21/1623

USPC ..... 399/107, 110, 123, 358, 360

See application file for complete search history.

(56) References Cited

U.S. PATENT DOCUMENTS

| | | | | |
|---|---|---|---|---|
| 8,195,079 | B2 * | 6/2012 | Tanaka et al. | G03G 21/12 399/360 |
| 8,843,030 | B2 * | 9/2014 | Ishikake | G03G 21/105 399/358 |
| 9,128,457 | B2 | 9/2015 | Koga | |
| 9,442,429 | B2 * | 9/2016 | Ueda et al. | G03G 21/105 |

FOREIGN PATENT DOCUMENTS

| | | | |
|---|---|---|---|
| JP | 2013-228544 | A | 11/2013 |

* cited by examiner

*Primary Examiner* — William J Royer
(74) *Attorney, Agent, or Firm* — Venable LLP

(57) ABSTRACT

An image forming apparatus includes a first body, an image forming portion, a first conveying passage provided inside of the first body and to convey toner discharged from the image forming portion, a second body detachably connected to the first body, and a second conveying passage to convey the toner received from the first conveying passage. The second conveying passage receives the toner from the first conveying passage in the first body. The second conveying passage is projected from the first body into the second body when the second body is connected to the first body, and is detachable from the first body while leaving the first conveying passage in the first body.

9 Claims, 12 Drawing Sheets

B-B SECTIONAL VIEW

IMAGE FORMING APPARATUS WITH DETACHABLE TONER CONVEYING PASSAGE

This application claims the benefit of Japanese Patent Application No. 2021-041914 filed on Mar. 15, 2021, which is hereby incorporated by reference herein in its entirety.

FIELD OF THE INVENTION AND RELATED ART

The present invention relates to an image forming apparatus, such as a copier, a printer, a fax machine, or a printing machine, of an electrophotographic type or an electrostatic recording type, and more specifically, to an image forming apparatus which includes a conveying mechanism for conveying a collected developer.

In an image forming apparatus of an electrophotographic type, etc., a residual toner, which remains on an image bearing member after a transfer step of a toner image from the image bearing member such as a photosensitive member or an intermediary transfer member to a transferred member, is removed and collected from the image bearing member by a cleaning means. The collected toner (collected toner, collected developer) is conveyed to and accumulated in a collecting container via a conveying passage which is provided inside the image forming apparatus. When a predetermined amount of the collected toner is accumulated, the collecting container is removed from the image forming apparatus by an operator such as a user or a service representative and replaced with an empty one.

The collecting container may be arranged inside a separate casing (second body, second casing) which is connected to a main assembly (first body, first casing) in which the image bearing member, etc., is disposed, in order to ease a replacement work by the operator. In this case, the conveying passage for the collected toner is formed to cross between the main assembly and the separate casing. Thus, it may be necessary to disassemble the conveying passage of the collected toner during a maintenance inside the image forming apparatus such as a part replacement, for example.

Japanese Laid-Open Patent Application (JP-A) 2013-228544 discloses a constitution in which a maintenance work is eased in a way such that a part of the conveying passage of the collected toner is movable and the conveying passage is retracted without disassembling it from an area that needs to be accessed during a maintenance operation.

However, there are situations where disassembly of the conveying passage of the collected toner is necessary, not only during a maintenance work inside the image forming apparatus as described above, but also during a downsizing work for installation or relocation of the image forming apparatus. That is, in a case of carrying the image forming apparatus through an aisle or an elevator which is smaller than an outline of the image forming apparatus in operation, downsizing work involving disassembly is required to downsize the image forming apparatus. In a case that the conveying passage of the collected toner projects from an outermost outline of the main assembly, the conveying passage is required to be disassembled in order to downsize.

Especially, in a case that the conveying passage of the collected toner is formed to cross between the main assembly (first body, first casing) and the separate casing (second body, second casing) which is connected to the main assembly as described above, a removal of the conveying passage from the main assembly and a disassembly of the conveying passage are required. And the removal work of the conveying passage from the main assembly and the disassembly work of the conveying passage may lead to a toner scattering. Thus, it may increase effort and time for a downsizing work of the image forming apparatus.

JP-A 2013-228544 does not mention a constitution of the conveying passage of the collected toner which adapts to the downsizing work for installation or relocation of the image forming apparatus.

Accordingly, an object of the present invention is to provide an image forming apparatus which makes it possible to facilitate the downsizing work involving separation of the first body and the second body in the image forming apparatus in which conveying passages of the collected developer are formed to cross between the first body and the second body.

SUMMARY OF THE INVENTION

The object described above is achieved with the image forming apparatus of the present invention. In summary, the present invention is an image forming apparatus comprising a first body, an image forming portion provided inside of the first body and configured to form a toner image, a first conveying passage provided inside of the first body and configured to convey toner discharged from the image forming portion, a second body detachably connected to the first body, and a second conveying passage configured to convey the toner received from the first conveying passage, wherein the second conveying passage is constituted to receive the toner from the first conveying passage in the first body, provided so as to be projected from the first body into the second body when the second body is connected to the first body, and constituted to be detachable from the first body while leaving the first conveying passage in the first body.

Further features of the present invention will become apparent from the following description of exemplary embodiments with reference to the attached drawings.

Figure 9:
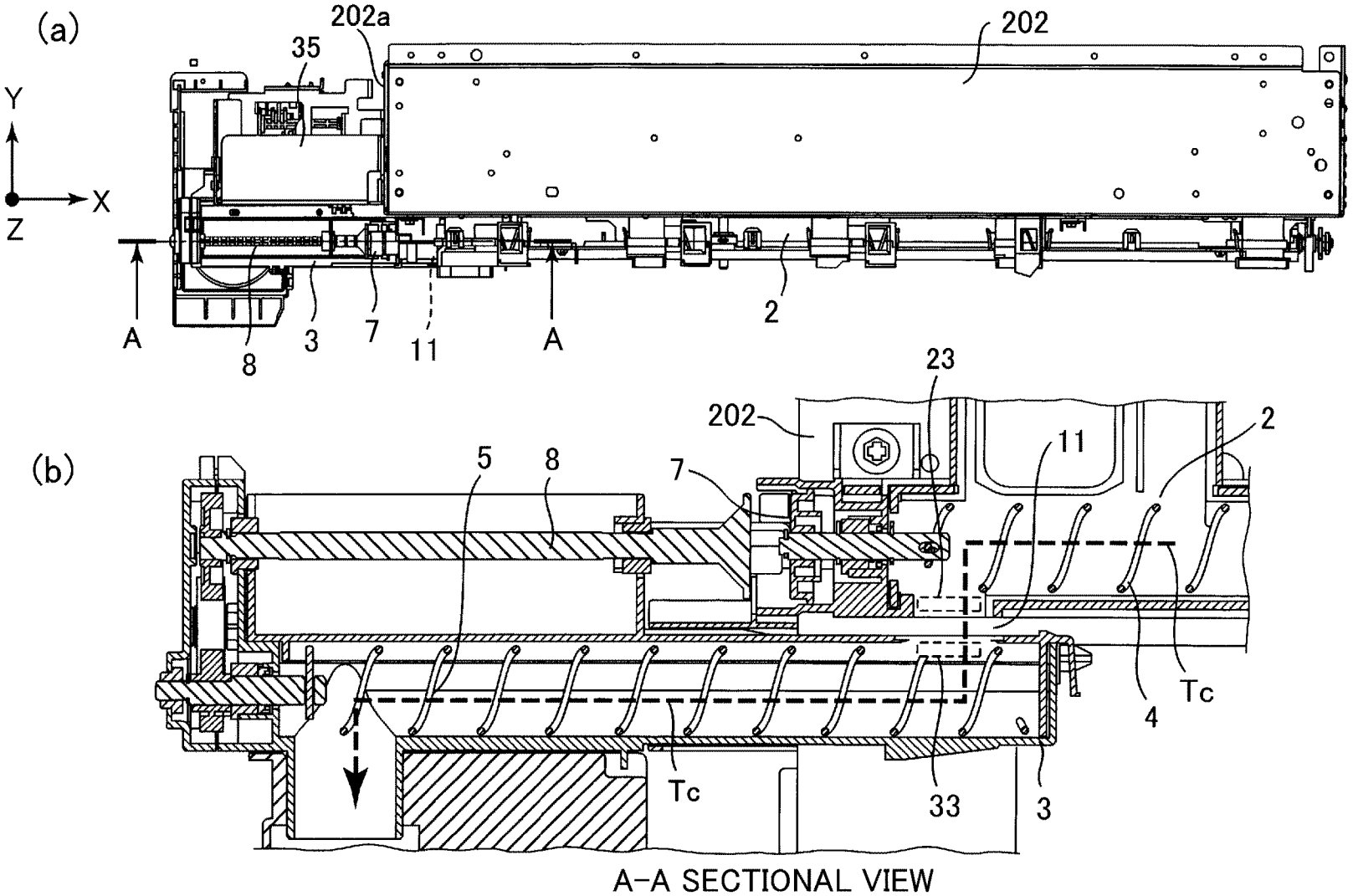

Parts (a) and (b) of FIG. 9 are a top view and a sectional view of a vicinity of a connection portion between a main pipe and an extension pipe.

Figure 10:
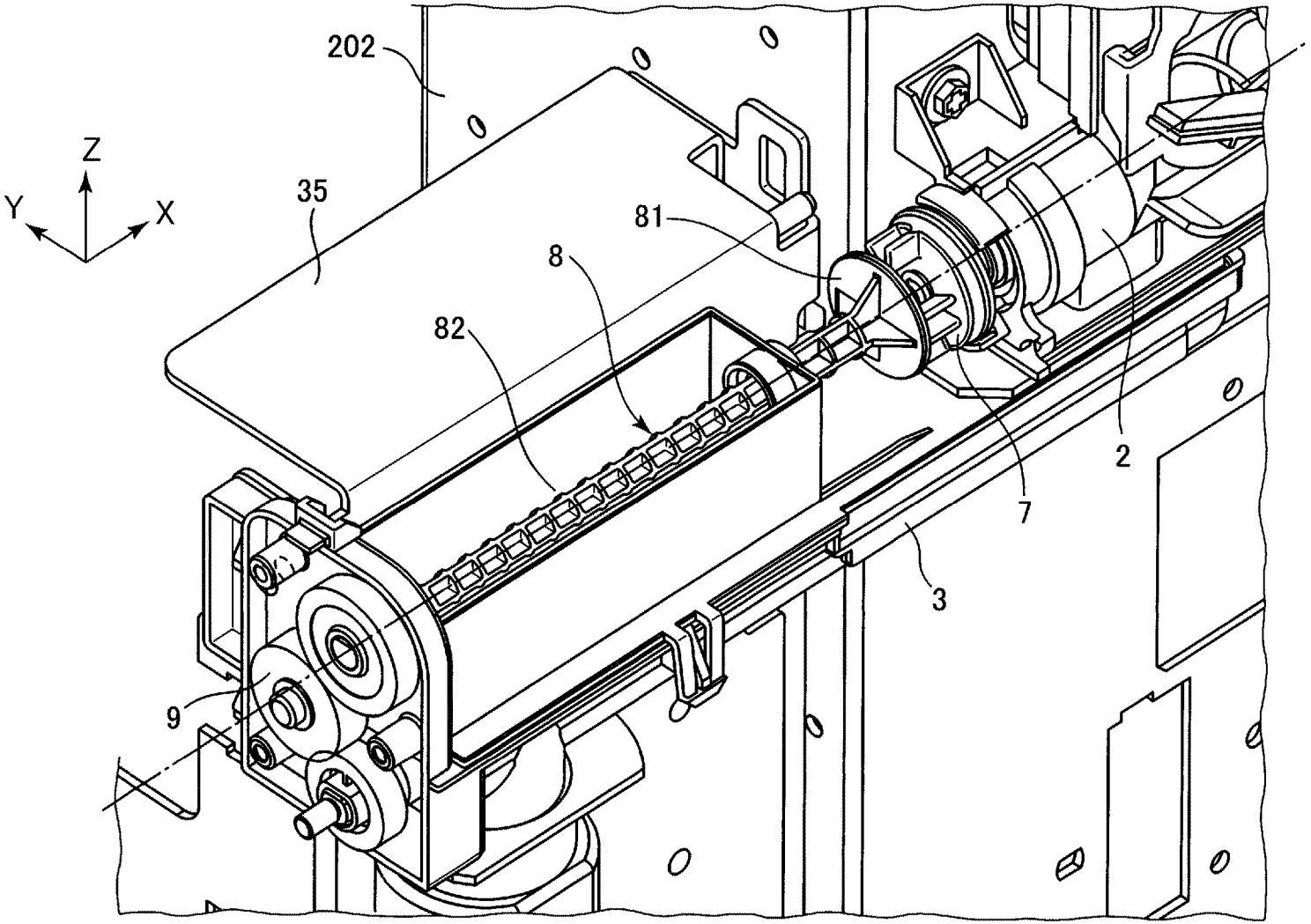

FIG. 10 is a perspective view of a vicinity of a connection portion between a main pipe and an extension pipe.

Figure 11:
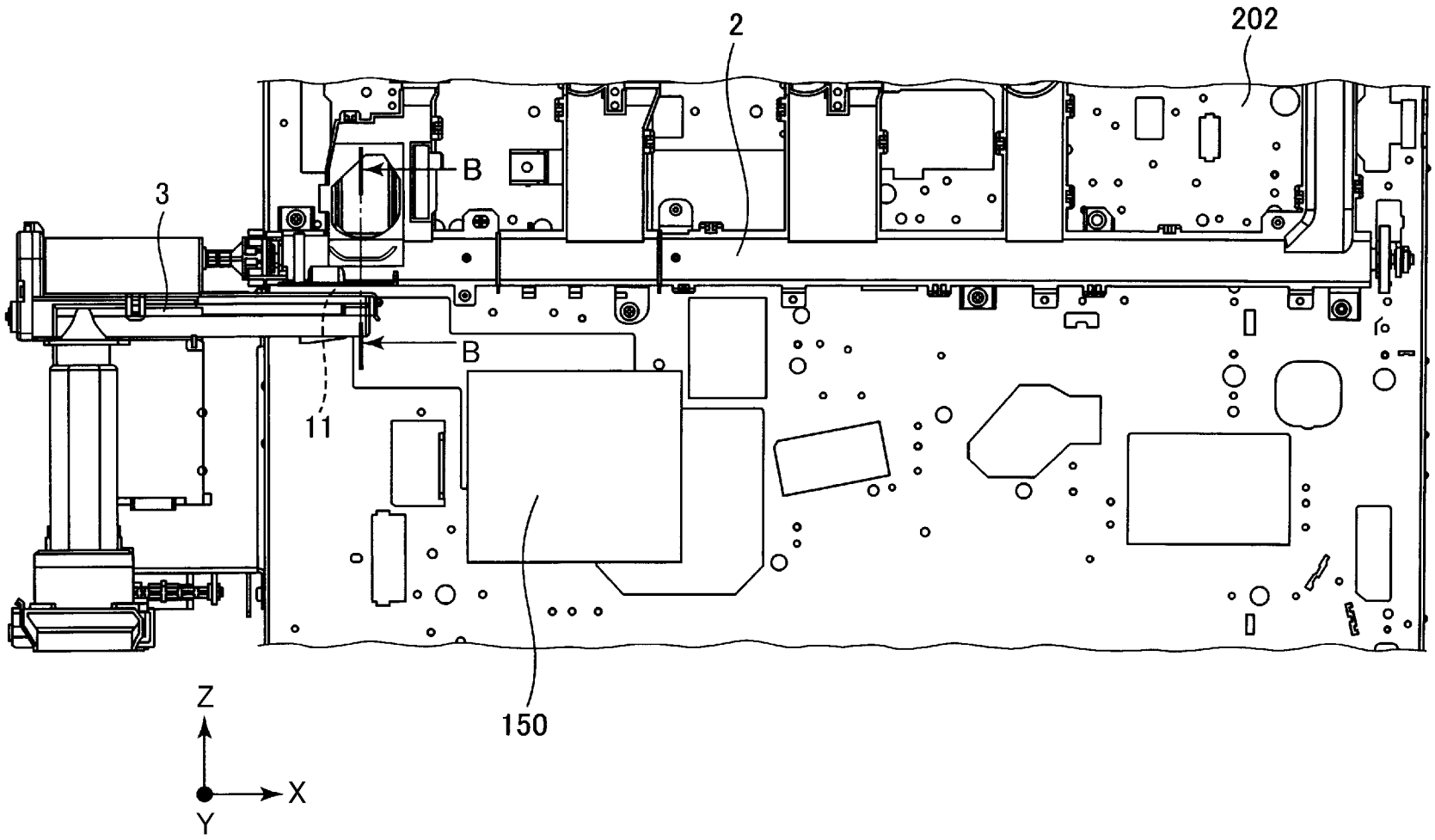

FIG. 11 is a front view showing a positional relationship between a conveying passage of collected toner and a fixing device.

Figure 12:
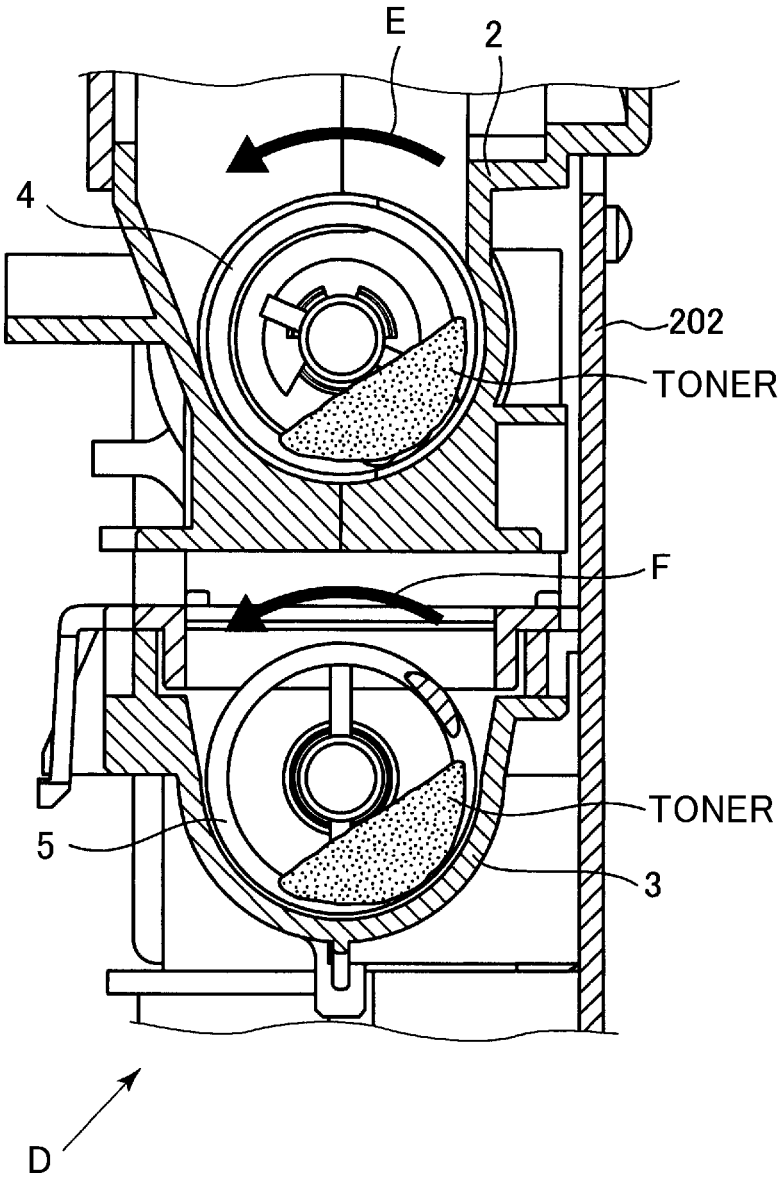

FIG. 12 is a sectional view of a conveying passage of collected toner.

DESCRIPTION OF THE EMBODIMENTS

In the following, an image forming apparatus according to the present invention will be described specifically with reference to the drawings.

1. Constitution of the Image Forming Apparatus

Figure 1:
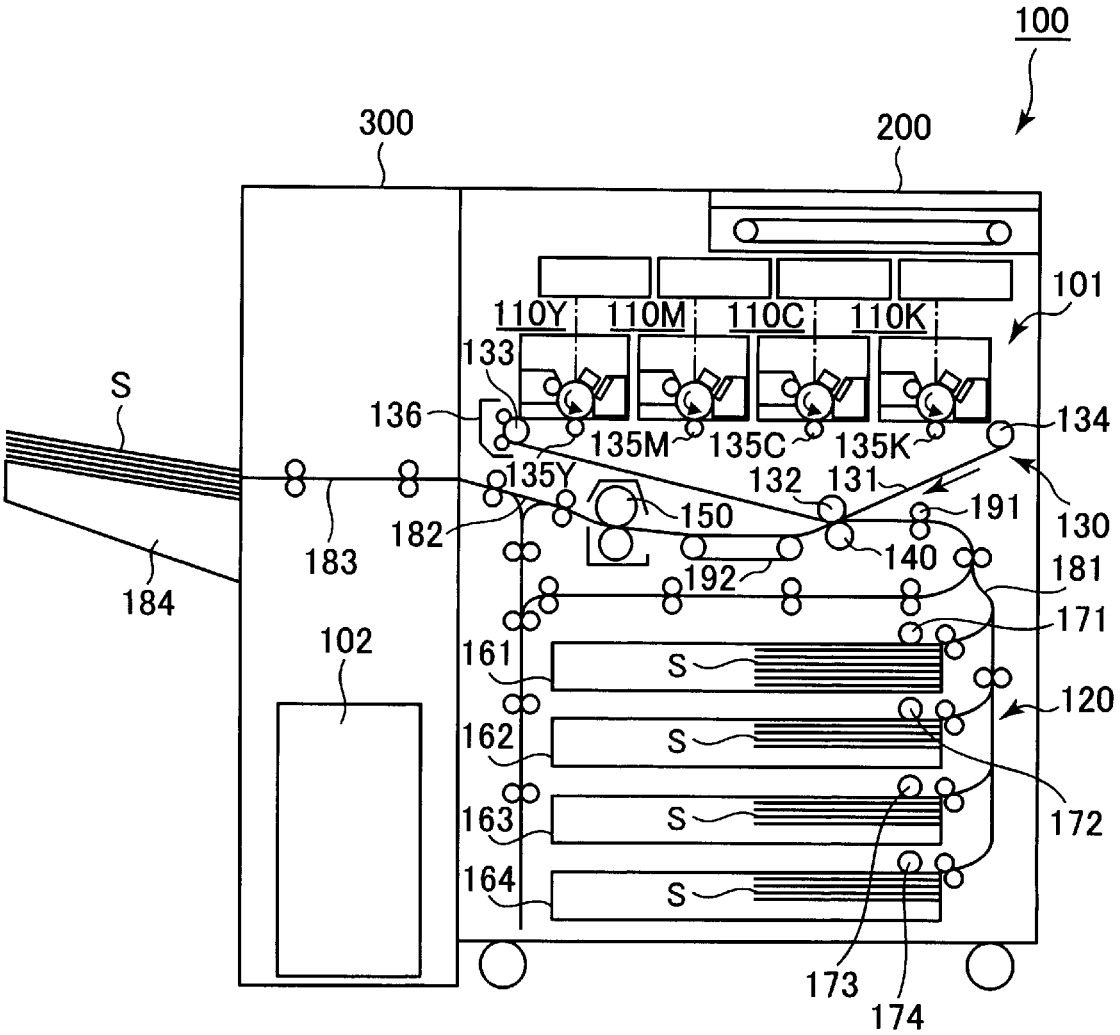
FIG. 1 is a schematic sectional view of an image forming apparatus.

FIG. 1 is a schematic sectional view of an image forming apparatus 100 in an embodiment. The image forming apparatus 100 in the embodiment is a tandem-type multifunction printer (which includes functions of a copier, a printer, and a fax machine) employing an intermediary transfer method, which is capable of forming full color images using an electrophotographic image forming process.

In the embodiment, the image forming apparatus 100 includes a main assembly 200 as a first body (main body, first casing) and an extension casing 300 as a second body (sub-body, second casing) which is attached to the main assembly 200. An image forming portion 101 is arranged in the main assembly 200. The image forming portion 101 is constituted so as to include image forming units 110Y, 110M, 110C and 110K, an intermediary transfer unit 130, a secondary transfer roller 140, a fixing device 150, etc. The main assembly 200 is also provided with a feeding device 120, a registration roller pair 191, a conveying belt 192, a feed conveying passage 181, a discharge conveying passage 182, etc. On the other hand, the extension casing 300 includes a space to accommodate a collecting container 102. The extension casing 300 is also provided with a relay conveying passage 183, a discharging tray 184, etc.

The image forming portion 101 includes first, second, third and fourth image forming units 110Y, 110M, 110C and 110K, which form yellow (Y), magenta (M), cyan (C) and black (K) images, respectively. The four image forming units 110Y, 110M, 110C and 110K are arranged in a row along a moving direction of a horizontal portion (image transfer surface) of an intermediary transfer belt 131, which will be described below. The image forming portion 101, for example, forms an image on a recording material S (recording medium, transfer material, sheet), such as paper, by an electrophotographic method according to an image signal which is sent from an external device such as a personal computer. Incidentally, for elements with the same or corresponding functions or constitutions to each color, Y, M, C, or K at an end of a code or reference numeral, which indicates an element for one of the colors, may be omitted for a general explanation.

Figure 2:
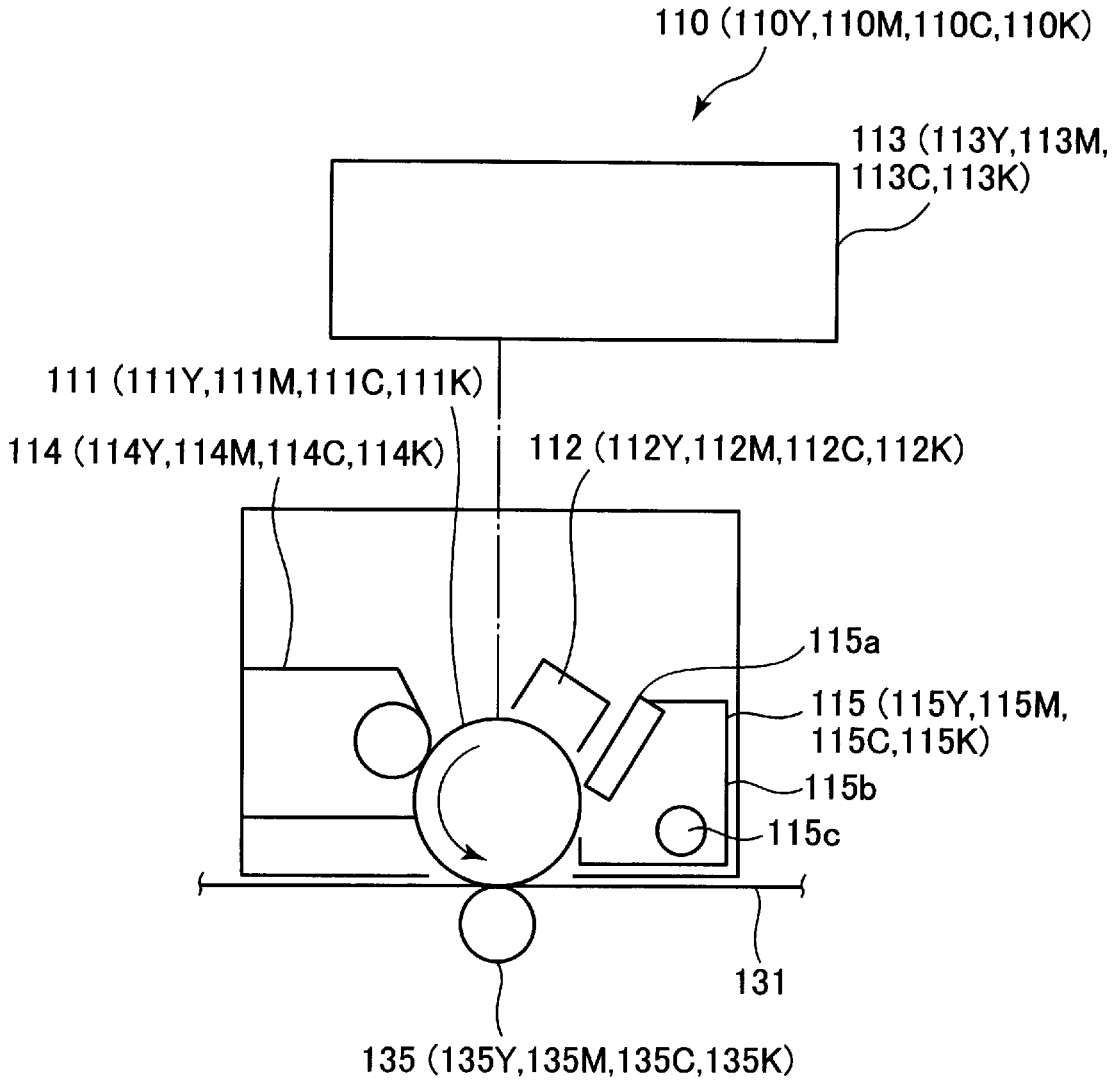
FIG. 2 is a schematic sectional view of an image forming unit.

FIG. 2 is a schematic sectional view showing a constitution of an image forming unit 110. The image forming unit 110 includes a photosensitive drum 111, which is a rotatable drum type (cylindrical) photosensitive member (electrophotographic photosensitive member) as a first image bearing member. Further, the image forming unit 110 includes a charger 112 as a charging means. Further, the image forming unit 111 includes an exposure device (laser scanner) 113 as an exposure means. Further, the image forming unit 110 includes a developing device 114 as a developing means. Further, the image forming unit 110 includes a drum cleaning device 115 as a photosensitive member cleaning means.

During image forming, a photosensitive drum 111 is rotationally driven in a counterclockwise direction in FIG. 1 and FIG. 2. A surface of the rotating photosensitive drum 111 is charged by the charger 112 to a predetermined potential of a predetermined polarity (negative polarity in the embodiment). The surface of the charged photosensitive drum 111 is scanned and exposed by the exposure device 113 with a laser beam according to image information, and an electrostatic latent image (electrostatic image) according to the image information is formed on the photosensitive drum 111. The electrostatic latent image formed on the photosensitive drum 111 is developed (visualized) by supplying toner as a developer (dry developer) by the developing device 114, and a toner image (toner image, developer image) is formed on the photosensitive drum 111.

The intermediary transfer unit 130 is arranged so as to oppose the four image forming units 110Y, 110M, 110C, and 110K. The intermediary transfer unit 130 includes the intermediary transfer belt 131, which is an intermediary transfer member constituted of an endless belt as a second image bearing member. The intermediary transfer belt 131 is stretched by a driving roller 133, a tension roller 134, and a secondary transfer opposing roller 132 as a plurality of stretching rollers (supporting rollers). The intermediary transfer belt 131 rotates (circulating movement) in a clockwise direction in FIG. 1, in a way that the driving roller 133 is rotationally driven and a driving force is transmitted. On an inner peripheral surface of the intermediary transfer belt 131, primary transfer rollers 135Y, 135M, 135C and 135K as primary transfer means are arranged corresponding to photosensitive drums 111Y, 111M, 111C, and 111K, respectively. The primary transfer roller 135 is urged toward the photosensitive drum 111 via the intermediary transfer belt 131, and forms a primary transfer portion where the photosensitive drum 111 contacts the intermediary transfer belt 131. A toner image formed on the photosensitive drum 111 is primary transferred onto the rotating intermediary transfer belt 131 in the primary transfer portion. During the primary transfer, a primary transfer voltage of an opposite polarity from a normal charging polarity of a toner (charging polarity during developing) is applied to the primary transfer roller 135. For example, during forming a full color image, each color toner image of yellow, magenta, cyan, and black formed on each of photosensitive drums 111 is primary transferred sequentially so as to overlap at a same image position on the intermediary transfer belt 131.

On an outer peripheral surface of the intermediary transfer belt 131, the secondary transfer roller 140 as a secondary transfer means is arranged at a position opposing the secondary transfer opposing roller 132. The secondary transfer roller 140 is urged toward the secondary transfer opposing roller 132 via the intermediary transfer belt 131 and forms a secondary transfer portion where the intermediary transfer belt 131 contacts the secondary transfer roller 140. The toner image formed on the intermediary transfer belt 131 is transferred onto the recording material S, which is nipped between the intermediary transfer belt 131 and the secondary transfer roller 140 and fed at the secondary transfer portion. During secondary transferring, a secondary transfer voltage of an opposite polarity from a normal charge polarity of a toner is applied to the secondary transfer roller 140. The recording material S is supplied from the feeding device 120. The feeding device 120 is constituted so as to include recording material cassettes 161 to 164 as recording material accommodating portions which accommodate the recording material S, feeding rollers 171 to 174 as feeding members, the feed conveying passage 181, etc. The recording material S is separated one by one from one of the recording material cassettes 161 to 164 by rotation of one of the feeding rollers 171 to 174, and fed into the feed conveying passage 181.

This recording material S is conveyed to the secondary transfer portion by the registration roller pair 191 as a conveying member so as to match with a timing of the toner image on the intermediary transfer belt 131.

The recording material S on which the toner image is transferred is conveyed to the fixing device 150 as a fixing means by the conveying belt 192. The fixing device 150 fixes (melts, sticks) the toner image on the recording material S by heating and pressuring the recording material S which bears the unfixed toner image. The recording material S, on which the toner image is fixed, is discharged (output) to the discharging tray 184 as a discharging portion which is provided with the extension casing 300, after passing through the discharge conveying passage 182 which is provided in the main assembly 200 and the relay conveying passage 183 which is provided in the extension casing 300.

Figure 3:
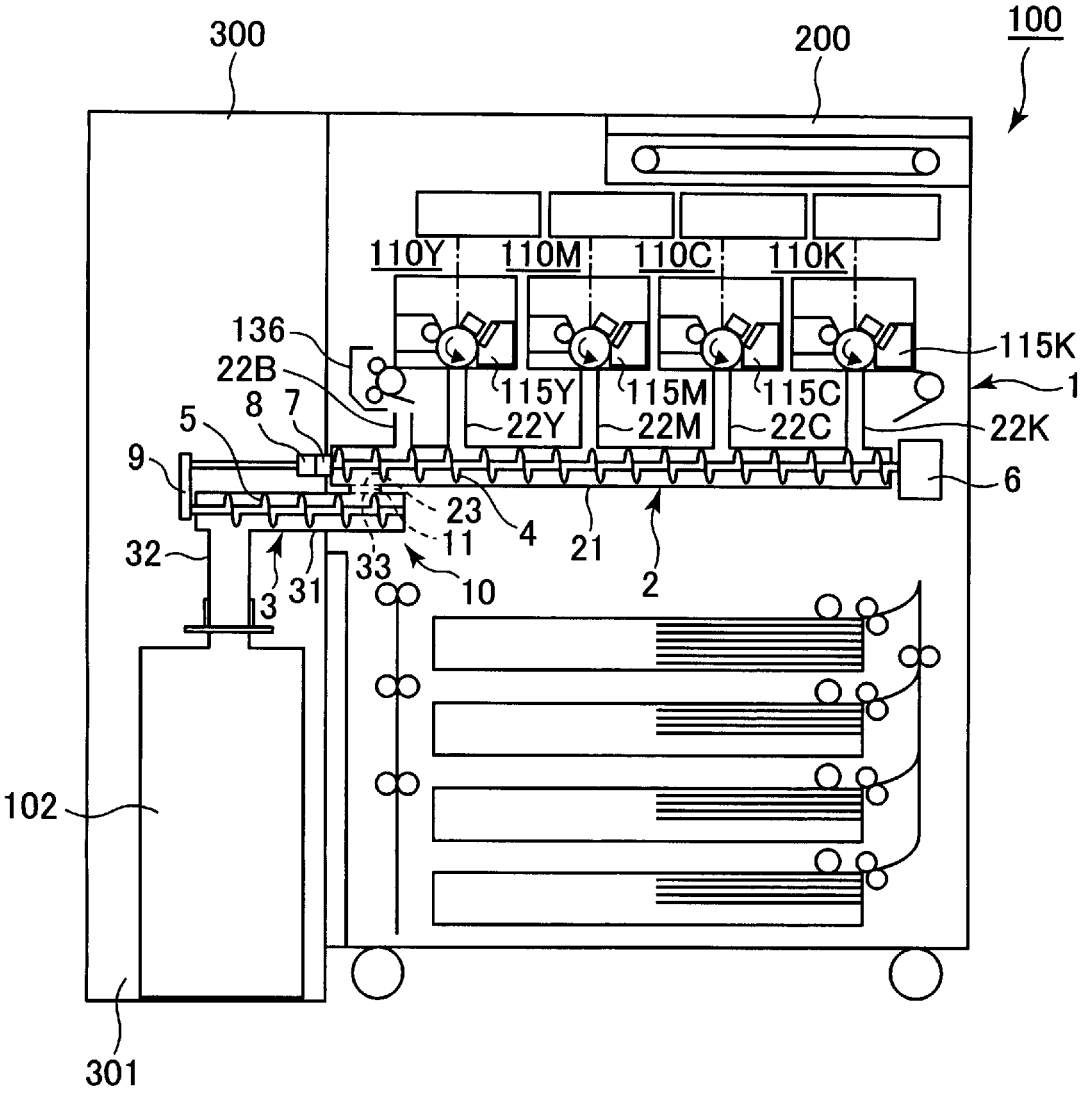
FIG. 3 is a schematic sectional view of an image forming apparatus showing a constitution of a conveying mechanism of collected toner.

On the other hand, residual toner (secondary transfer residual toner), which remains on the photosensitive drum 111 due to incomplete transfer to the intermediary transfer belt 131 during primary transferring, is removed from the photosensitive drum 111 and collected by the drum cleaning device 115. Further, residual toner (secondary transfer residual toner), which remains on the intermediary transfer belt 131 due to incomplete transfer to the recording material S during secondary transfer, is removed from the intermediary transfer belt 131 and collected by a belt cleaning device 136. The toner (collected toner), collected by the drum cleaning device 115 and the belt cleaning device 136, is conveyed via a collected toner conveying passage 10 (FIG. 3) as will be described in detail below, and accommodated in the collecting container 102, which is arranged inside the extension casing 300. Incidentally, in the embodiment, the drum cleaning device 115 is a blade cleaning type. That is, in the embodiment, the drum cleaning device 115 is constituted so as to include a cleaning blade 115*a* as a cleaning member, a cleaning container 115*b*, and a conveying member 115*c* which conveys the collected toner inside the cleaning container 115*b*. The drum cleaning device 115 scrapes off the residual toner from a surface of the rotating photosensitive drum 111 by the cleaning blade 115*a* which is urged with the surface of the photosensitive drum 111, and accommodates it inside the cleaning container 115*b*. The collected toner inside the cleaning container 115*b* is conveyed by the conveying member 115*c*, discharged from the cleaning container 115*b*, and conveyed to the collected toner conveying passage 10 (FIG. 3). Further, in the embodiment, the belt cleaning device 136 is also of the blade cleaning type which includes a generally similar constitution to the drum cleaning device 115.

2. Conveying Mechanism of Collected Toner

Next, the conveying mechanism of the collected toner in the embodiment will be described. FIG. 3 is a schematic sectional view showing a constitution of a conveying mechanism 1 of the collected toner which is arranged inside the image forming apparatus 100. Incidentally, a front side of a drawing sheet of FIG. 1 and FIG. 3 is defined as a front side of the image forming apparatus 100, and a rear side of the drawing sheet is defined as a rear side of the imaging forming apparatus 100. A front-to-back direction which connects the front side and the rear side is substantially parallel to a direction of a rotational axis of the photosensitive drum 111 and the stretching roller of the intermediary transfer belt 131. Further, a left side and a right side of the image forming apparatus 100 in a case of viewing from the front side are defined as a left side and a right side of the image forming apparatus 100, respectively. Further, an up-down direction refers to up and down in a gravitational direction (vertical direction); however, it does not mean only directly above and directly below, but also includes an upper side and a lower side of a horizontal plane which passes through a target element or position. In the figures, sometimes, a right and left direction described above is referred to as an "X-axis direction", the front-to-back direction described above is referred to as a "Y-axis direction", and a direction (substantially gravitational direction in general) perpendicular to both of the "X-axis direction" and the "Y-axis direction" is referred to as a "Z-axis direction".

In the embodiment, the conveying mechanism 1 of the collected toner includes a main pipe 2 as a first conveying passage and an extension pipe 3 as a second conveying passage. The main pipe 2 and the extension pipe 3 form the collected toner conveying passage 10. In the embodiment, the collected toner conveying passage 10 is arranged in the rear side of the main assembly 200. In the embodiment, the main pipe 2 is constituted so as to include a main pipe principal portion 21 extending in a right and left direction, and collecting connection portions 22 (22Y, 22M, 22C, 22K, and 22B), each of which connects a discharging source of the collected toner and the main pipe principal portion 21. In the embodiment, each of the collecting connection portions 22 is provided to extend above the main pipe principal portion 21. The main pipe principal portion 21 and each of the collecting connection portions 22 are substantially integrally formed, and an inside of the main pipe principal portion 21 is connected to an inside of each of the collecting connection portions 22. Incidentally, in the embodiment, the discharging source of the collected toner includes the drum cleaning devices 115Y, 115M, 115C, and 115K and the belt cleaning device 136. Incidentally, in the embodiment, the extension pipe 3 is constituted so as to include an extension pipe principal portion 31 which is extending in a right and left direction, and a discharging connection portion 32 which connects the extension pipe principal portion 31 and the collecting container 102. In the embodiment, the discharging connection portion 32 is provided to extend downward from the extension pipe principal portion 31. The extension pipe principal portion 31 and the discharging connection port 32 are substantially integrally formed, and an inside of the extension pipe principal portion 31 is connected to an inside of the discharging connection part 32. Further, in the embodiment, the conveying mechanism 1 includes a main pipe screw 4 as a first conveying member which is arranged inside the main pipe principal portion 21 of the main pipe 2. Further, in the embodiment, the conveying mechanism 1 includes an extension pipe screw 5 as a second conveying member which is arranged inside the extension pipe principal portion 31 of the extension pipe 3. In addition, in the embodiment, the conveying mechanism 1 includes a motor 6 as a driving member (driving source), a coupling 7 as a connecting member, a coupling shaft 8 and a gear train 9, a holding member 35 (FIG. 5) as a holding portion, etc.

Each of the drum cleaning devices 115Y, 115M, 115C and 115K is arranged to oppose each of the photosensitive drums 111Y, 111M, 111C and 111K. Further, the belt cleaning device 136 is arranged to oppose the intermediary transfer belt 131 at a position opposing the driving roller 133. And the collected toner, which is collected in each of the drum cleaning devices 115, is discharged from each of the drum cleaning devices 115 and moves to an inside of the main pipe 2. In the embodiment, the collected toner, which is discharged from each of the drum cleaning devices 115, falls in each of the collecting connection portions 22Y, 22M, 22C and 22K of the main pipe 2 by gravity and moves into an inside of the main pipe principal portion 21 of the main pipe 2. In the same way, the collected toner, which is collected in the belt cleaning device 136, is discharged from the belt cleaning device 136 and moves into the inside of the main pipe 2. In the embodiment, the collected toner, which is discharged from the belt cleaning device 136, falls in the collecting connection portion 22B of the main pipe 2 by gravity and moves into the inside of the main pipe principal portion 21 of the main pipe 2.

The main pipe principal portion 21 is arranged to extend in a right and left direction so as to cross an inside of the main assembly 200, and forms the collected toner conveying passage 10 inside the main assembly 200. The main pipe screw 4, which is arranged inside the main pipe principal portion 21, rotates by transmitting of a driving force from the motor 6. By the rotation of the main pipe screw 4, the collected toner, which is moved into the main pipe principal portion 21, is conveyed inside the main pipe principal portion 21 in a leftward direction.

The extension pipe 3 is arranged below the main pipe 2. In the embodiment, the extension pipe 3 is arranged so that a vicinity of an end portion in a right side of the extension pipe principal portion 31 is positioned below a vicinity of an end portion in a left side of the main pipe principal portion 21. The main pipe 2 and the extension pipe 3 are fixed to the main assembly 200. As a result, a main pipe opening portion 23, which is provided in the vicinity of the end portion in the left side of the main pipe principal portion 21 and opens downward, and an extension pipe opening portion 33, which is provided in the vicinity of the end portion in the right side of the extension pipe principal portion 31, fit together and a conveying passage connection portion 11 is formed. The conveying passage connection portion 11 constitutes a delivering portion which delivers the collected toner from the main pipe 2 to the extension pipe 3. The collected toner, which is conveyed inside the main pipe 2, falls by gravity in the conveying passage connection portion 11 and moves to an inside of the extension pipe principal portion 31 of the extension pipe 3. A fixing of the main pipe 2 and the extension pipe 3, and an arrangement of the conveying passage connection portion 11 will be described further below.

The extension pipe principal portion 31 is arranged to extend in a right and left direction so as to cross between the main assembly 200 and the extension casing 300, and forms the collected toner conveying passage 10 which delivers the collected toner from an inside of the main assembly 200 to an inside of the extension casing 300. However, as mentioned above, the extension pipe 3 is fixed to the main assembly 200. The extension pipe screw 5, which is arranged inside the extension pipe principal portion 31, rotates by receiving a power of the main pipe screw 4 via the coupling 7, the coupling shaft 8 and the gear train 9. By rotating of the extension pipe screw 5, the collected toner, which is moved to the inside of the extension pipe principal portion 31, is conveyed in a left direction. A driving connection of the main pipe screw 4 and the extension pipe screw 5 will be further described below.

The collecting container 102 is arranged in a container arrangement portion 301, which is a space inside the extension casing 300 formed by the extension casing 300. The collecting container 102 is dismountable from the extension casing 300. The collecting container 102 is connected to the discharging connection portion 32 which is provided in a vicinity of an end portion in a left side of the extension pipe 3, when it is mounting on the extension casing 300. When the collecting container 102 is connected to the extension pipe 3, by a rotation of the extension pipe screw 5, the collected toner falls by gravity in the discharging connection portion 32 of the extension pipe 3 and moves to an inside of the collecting container 102, and the collected toner is accumulated inside the collecting container 102.

3. Downsizing of Image Forming Apparatus

Next, a downsizing of the image forming apparatus 100 in the embodiment will be described.

(Connection of Extension Casing and Extension Pipe to Main Assembly)

Figure 4:
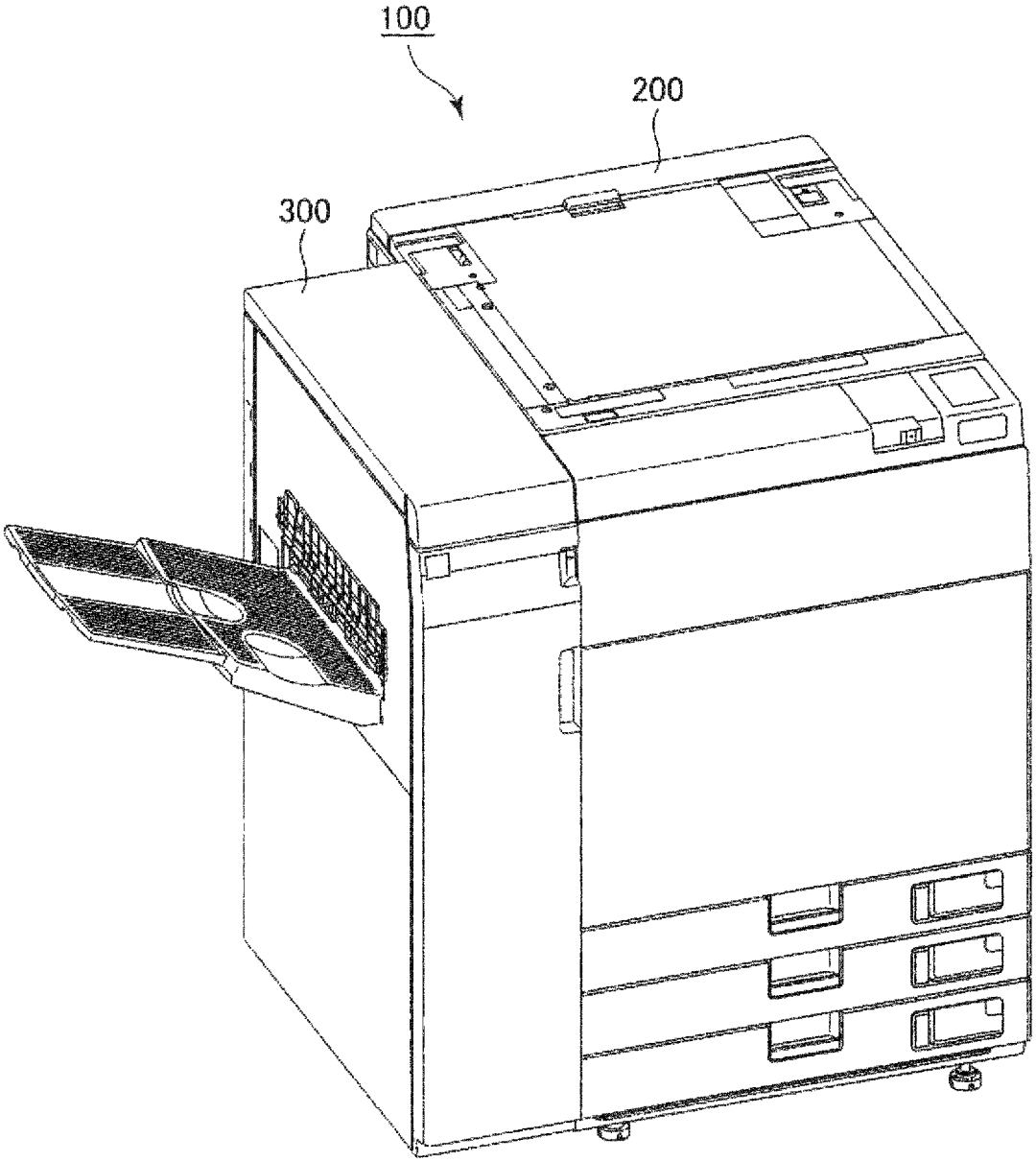
FIG. 4 is a perspective view of an image forming apparatus.

First, a connection of the extension casing 300 and the extension pipe 3 to the main assembly 200 will be described. FIG. 4 is a perspective view showing the image forming apparatus 100 while the main assembly 200 and the extension casing 300 are connected. That is, FIG. 4 shows the image forming apparatus 100 which is ready for operation, while the extension casing 300 is fixed to the main assembly 200.

Figure 5:
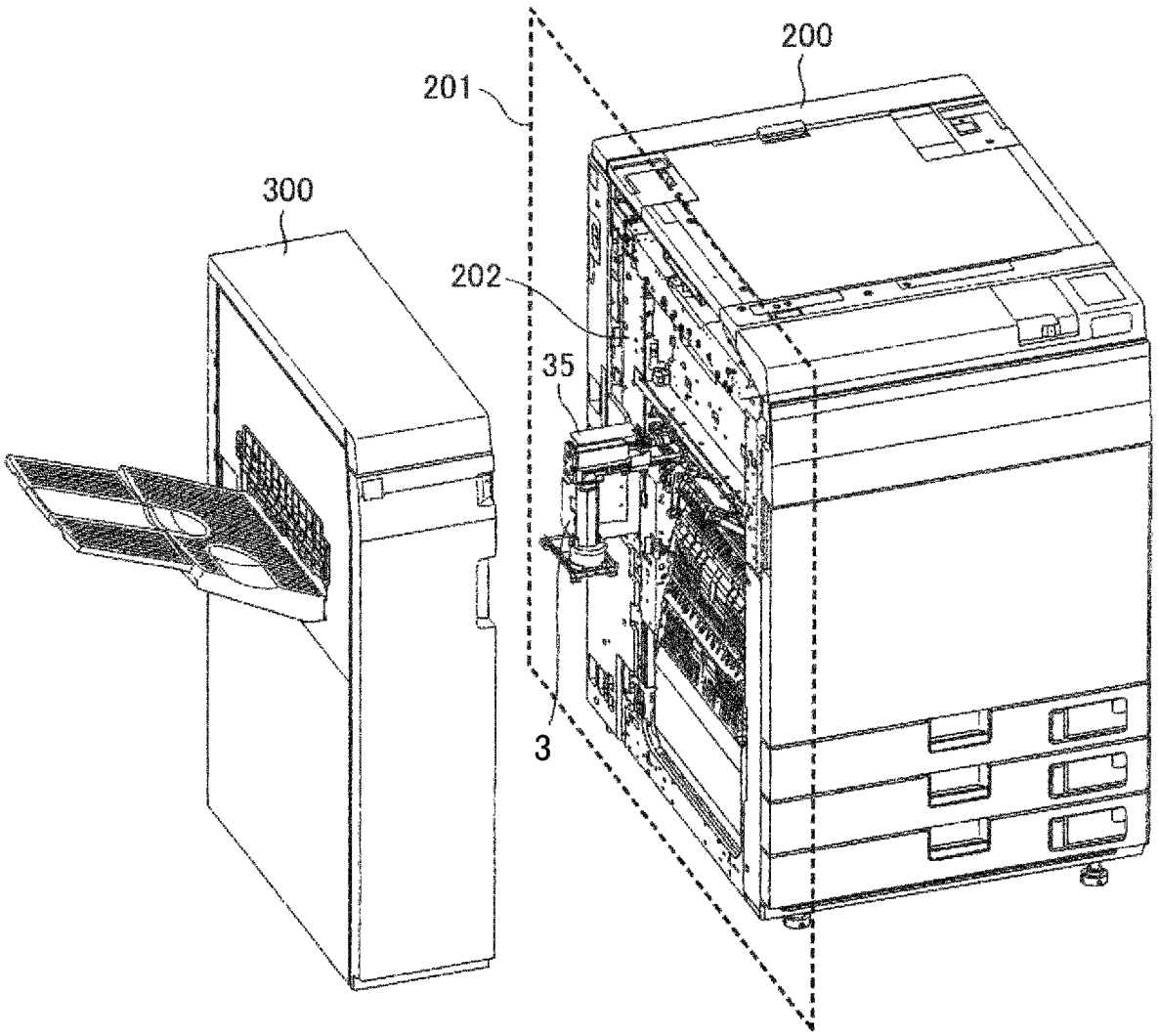
FIG. 5 is an exploded perspective view of an image forming apparatus while an extension body is removed from a main assembly.

FIG. 5 is an exploded perspective view showing the image forming apparatus 100 while the extension casing 300 is removed from the main assembly 200. The extension pipe 3 and the holding member 35 as the holding portion which holds the extension pipe 3 to the main assembly 200 are fixed to a side portion 201 of the main assembly 200 which will be described in detail below. Since the extension pipe 3 should be connected to the collecting container 102 which is arranged inside the extension casing 300, the extension pipe 3 protrudes from the side portion 201 of the main assembly 200 to the extension casing 300 side while the extension pipe 3 is attached to the main assembly 200.

Figure 6:
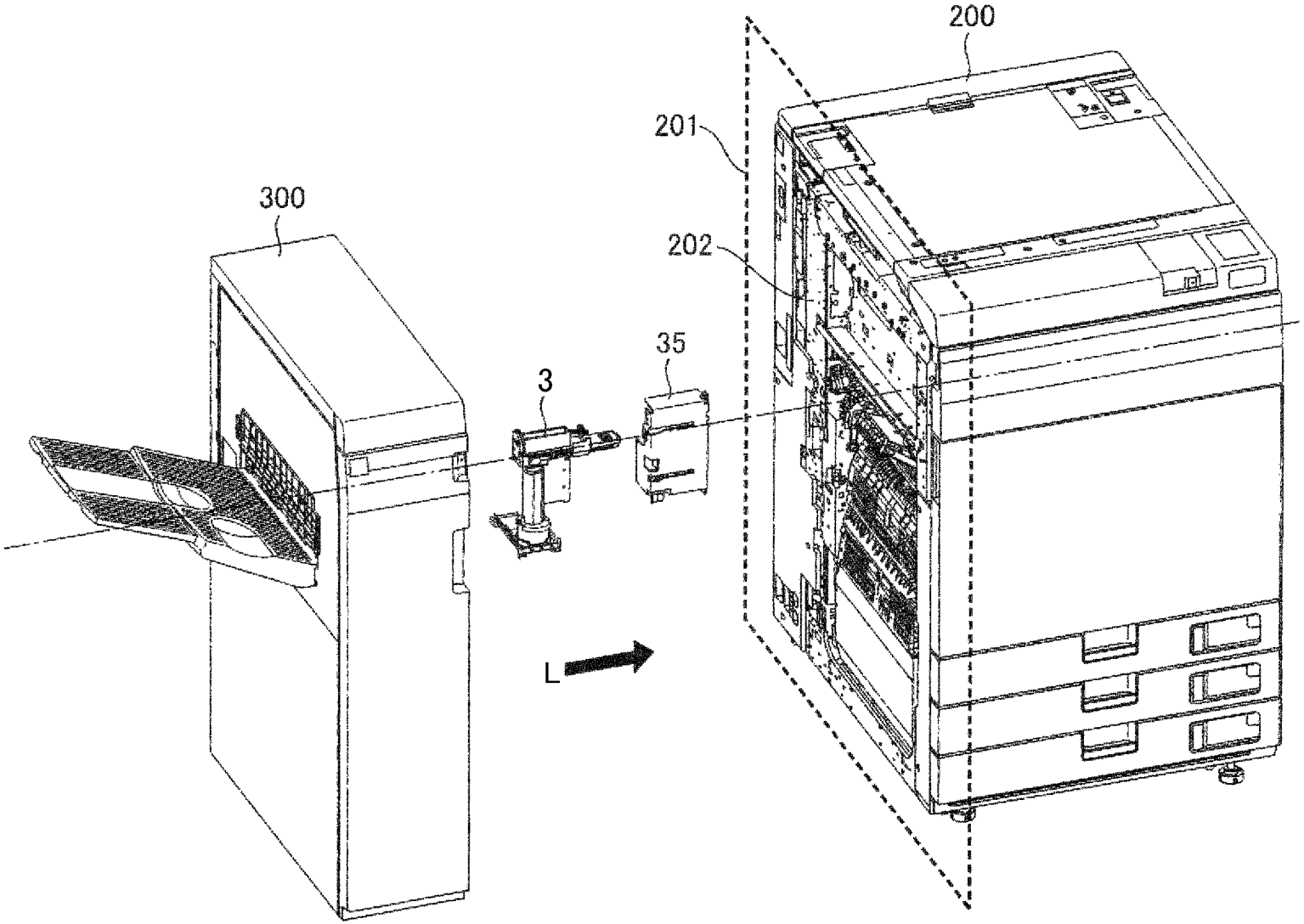
FIG. 6 is an exploded perspective view of an image forming apparatus while an extension body and an extension pipe are removed from a main assembly.

FIG. 6 is an exploded perspective view showing the image forming apparatus 100 while the extension pipe 3 and the holding member 35 are further removed from the main assembly 200 from FIG. 5. In the embodiment, a state shown in FIG. 6, in which the extension casing 300, the extension pipe 3 and the holding member 35 are removed from the main assembly 200, is defined as a downsized form of the image forming apparatus 100. The extension pipe 3, the holding member 35, and the extension casing 300 are fixed to the side portion 201 of the main assembly 200 from a left direction of the main assembly 200 which is shown as an arrow L in FIG. 6.

Here, the side portion 201 of the main assembly 200 is a portion of a vicinity of a side plane, on which the extension casing 300 of the main assembly 200 is mounted, where it is possible for an operator to access and an operation of mounting and dismounting of the parts is possible when the extension casing 300 is removed from the main assembly 200. The side portion 201 is not limited to, for example, a side plane of an outermost side which opposes a side of the extension casing 300 of the main assembly 200, but includes a portion which is further inside of the main assembly 200 than the side plane and is accessible for an operator. Incidentally, it may be a constitution in which the extension pipe 3 is removable from the main assembly 200 without removing an entire extension casing 300 from the main assembly 200. For example, when a cover which covers a main body of the extension casing 300 is removed, the extension pipe 3 is exposed, so the extension pipe 3 may be removed before removing a container arrangement portion 301 and after removing the collecting container 102 from the main body of the extension casing 300.

In this way, in the embodiment, the extension pipe 3 is constituted to fix to the side portion 201 of the main assembly 200 which is exposed when the extension casing 300 is removed from the main assembly 200. As a result, it is possible to easily remove the extension pipe 3 which protrudes from the main assembly 200 by removing the extension casing 300 from the main assembly 200. Thus, it is possible to easily disassemble the collected toner conveying passage 10 and simplify a downsizing work when carrying the image forming apparatus 100.

(Fixing Extension Pipe)

Figure 7:
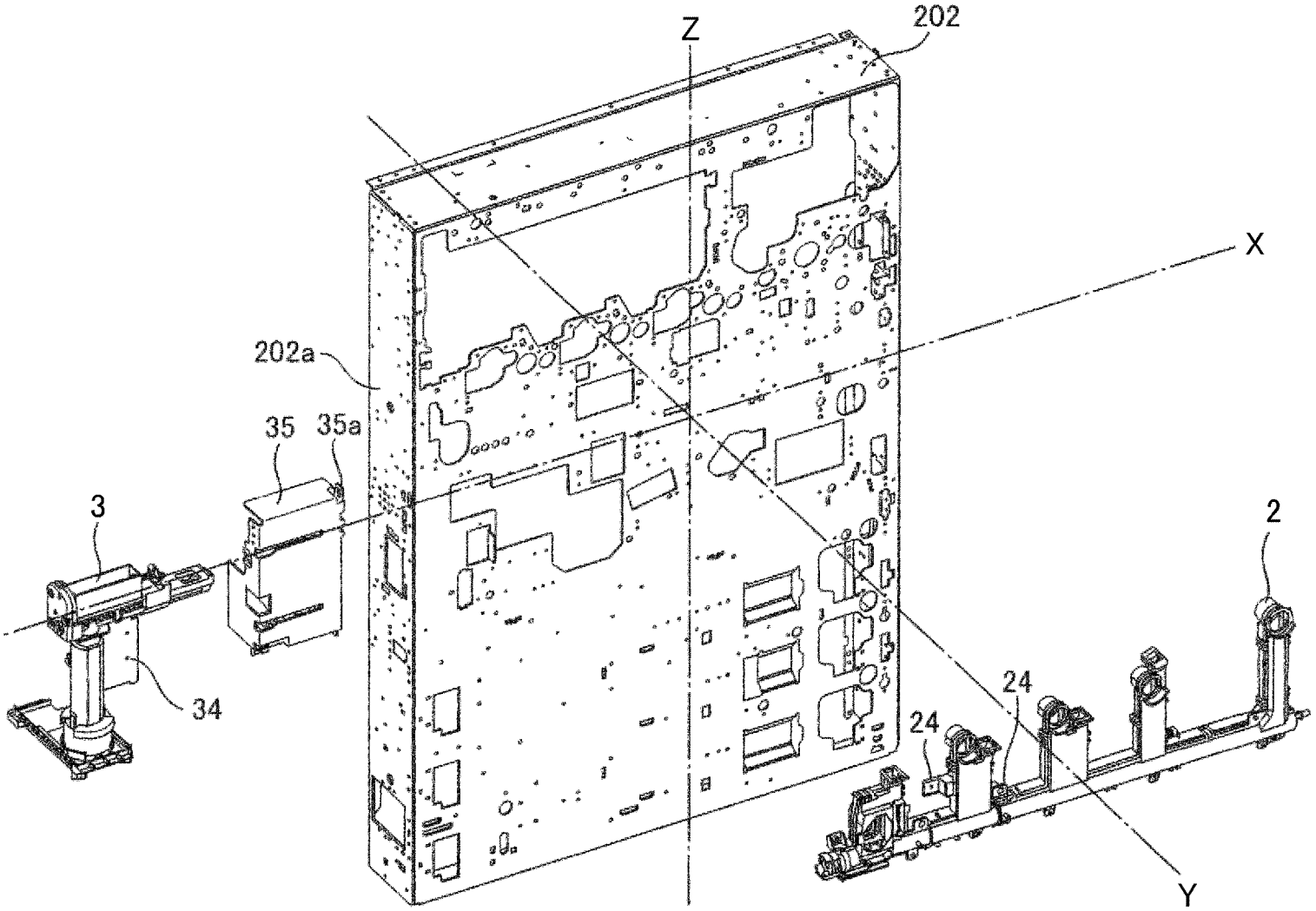
FIG. 7 is an exploded perspective view to illustrate how to fix an extension pipe.
Figure 8:
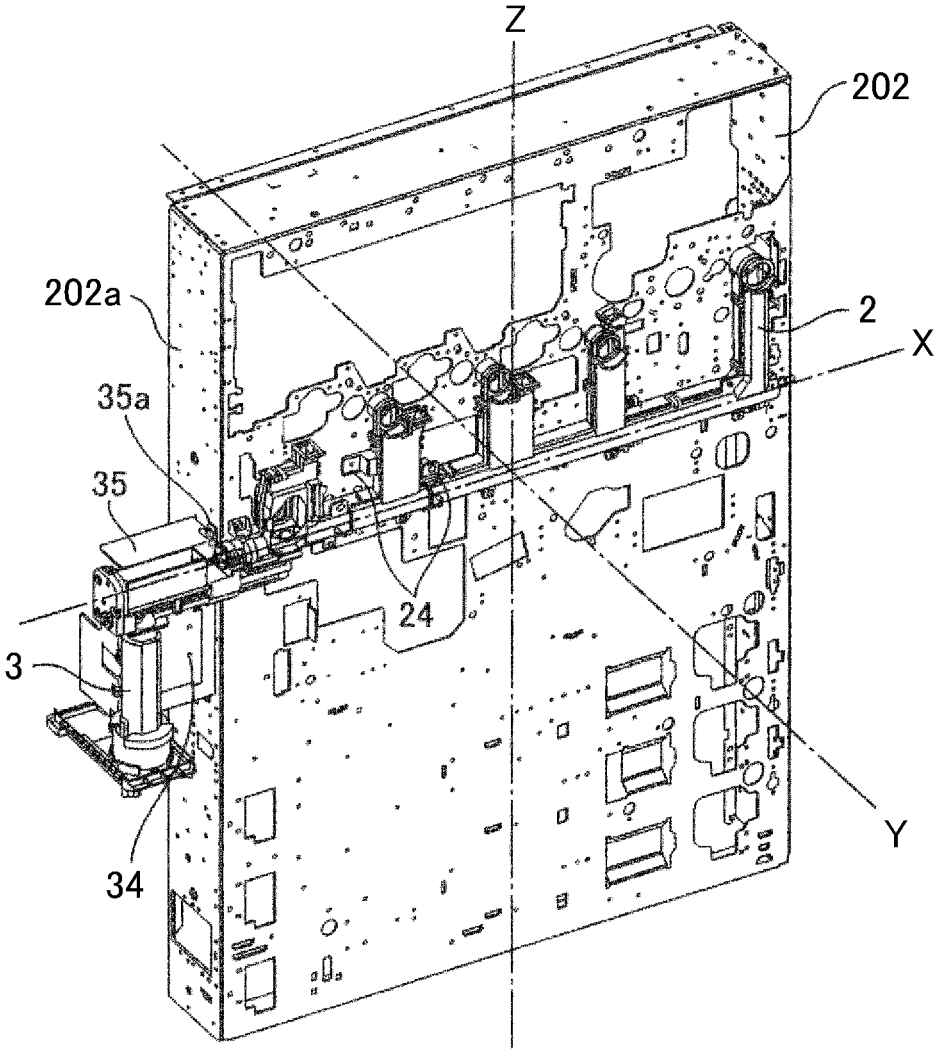
FIG. 8 is a perspective view to illustrate how to fix an extension pipe.

Next, a fixing of the extension pipe 3 to the main assembly 200 will be described in more detail. FIG. 7 is an exploded perspective view showing a state while the main pipe 2 and the extension pipe 3 are removed from a frame 202 of the main assembly 200 which will be described below. Further, FIG. 8 is a perspective view showing a state while the main pipe 2 and the extension pipe 3 are fixed to the frame 202 of the main assembly 200 which will be described below.

The frame 202 as a support member which is arranged in the main assembly 200 is a part to which multiple modules provided with the main assembly 200 are fixed. In the embodiment, the frame 202 is provided with the main assembly 200 and a rear side plate which is provided in a rear side of the main assembly 200 to which at least a part of the image forming portion 101 is attached. The main pipe 2 is fixed from a front (Y-axis direction) of the main assembly 200 to the frame 202. In the embodiment, the main pipe 2 is fixed to a front facing surface of the frame 202 by a fixing means such as a screw at a main pipe fixing portion 24.

The holding member 35 is a part for holding the extension pipe 3 to the main assembly 200. The holding member 35 is fixed to the frame 202 from a left direction (X-axis direction) of the main assembly 200. In the embodiment, a mounting portion 202*a*, which constitutes of a left facing surface of the frame 202, constitutes at least a part of the side portion 201 of the main assembly 200. In the embodiment, the holding member 35 is fixed to the mounting portion 202*a* of the frame 202 by a fixing means such as a screw at a holding member fixing portion 35*a*. And in the embodiment, the extension pipe 3 is fixed to the holding member 35 by a fixing means such as a screw at an extension pipe fixing portion 34. That is, the extension pipe 3 is fixed by screws to the frame 202 from the left direction (X-axis direction) of the main assembly 200 and a mounting direction of the screws (direction of rotational axis of screws) is the left direction (X-axis direction) of the main assembly 200. The holding member 35 may be fixed to the extension pipe 3 after fixing to the frame 202, or it may be fixed to the frame 202 after the extension pipe 3 is fixed. Further, in the embodiment, the main pipe 2 and the extension pipe 3 are not directly fixed to each other.

By fixing the main pipe 2 and the extension pipe 3 to the same frame 202, it is possible to reduce a misalignment of the main pipe opening portion 23 and the extension pipe opening portion 33 which form the conveying passage connection portion 11. As a result, the misalignment, which needs to be considered in designing parts, is reduced, so it is possible to miniaturize parts.

Incidentally, in the embodiment, in order to reduce the misalignment of the parts described above, the main pipe 2 and the extension pipe 3 are fixed to the frame 202 which is a same part in the main assembly 200. However, the present invention is not limited to this mode, and the main pipe 2 and the extension pipe 3 may be fixed to a different part in the main assembly 200.

Further, in the embodiment, a holding portion which holds the extension pipe 3 is constituted as a holding member 35 which is a separate part from the extension pipe 3, however, the holding portion may be constituted as a holding shape portion which is substantially integrally formed with the extension pipe 3.

4. Connection of Conveying Passage

Next, the conveying passage connection portion 11, which is formed by the main pipe opening portion 23 and the extension pipe opening portion 33, will be described in more detail. Part (a) of FIG. 9 is a top view showing a vicinity of a connection portion between the main pipe 2 and the extension pipe 3. Further, part (b) of FIG. 9 is a sectional view along line A-A in part (a) of FIG. 9.

As shown in part (b) of FIG. 9, the main pipe opening portion 23 which is opening downward and the extension pipe opening portion 33 which is opening upward, oppose each other, then, the conveying passage connection portion 11 is formed and the collected toner conveying passage 10 is formed. In part (b) of FIG. 9, the collected toner is conveyed along a passage shown by a dashed arrow Tc.

And in the embodiment, as shown in parts (a) and (b) of FIG. 9, the conveying passage connection portion 11 is arranged inside an area (projection area) which projects forward (Y-axis direction) the frame 202 arranged inside the main assembly 200. In short, the main pipe opening portion 23 is arranged inside the main assembly 200. Thus, it is possible to reduce an amount of the main pipe 2 protruding from the main assembly 200. This is, a carrying workability is improved, since it is possible to reduce an external size of the main assembly 200 in the downsized form during carrying the image forming apparatus 100.

5. Driving Connection

Next, the driving connection between the main pipe screw 4 and the extension pipe screw 5 will be described. FIG. 10 is a perspective view showing a vicinity of a connection portion between the main pipe 2 and the extension pipe 3.

The coupling 7 is a driving transmission member which is arranged outside the main pipe 2 and connected to the main pipe screw 4 arranged inside the main pipe 2. In the embodiment, the coupling 7 is connected to an end portion of a left side of the main pipe screw 4. The coupling 7 rotates coaxially and integrally with the main pipe screw 4 by a rotation of the main pipe screw 4 which receives power from the motor 6 (FIG. 3). The coupling shaft 8 is a driving transmission member which is arranged outside the extension pipe 3 and held by the extension pipe 3. The coupling shaft 8 includes a coupling portion 81 which receives power from the coupling 7, and a shaft portion 82 which rotates coaxially and integrally with the coupling portion 81. The coupling 7 and the coupling shaft 8 rotate coaxially and integrally by dismountably engaging the coupling 7 with the coupling portion 81 of the coupling shaft 8. In the embodiment, by fixing the extension pipe 3 to the main assembly 200, it is possible to engage the coupling 7 with the coupling portion 81 of the coupling shaft 8. The gear train 9 is a driving train which is constituted of three gears, arranged outside of the extension pipe 3 and held by the extension pipe 3. One end of the gear train 9 is connected to the coupling shaft 8, and the other end of the gear train 9 is connected to the extension pipe screw 5 which is arranged inside the extension pipe 3. In the embodiment, the gear train 9 is connected to an end portion of a left side of the coupling shaft 8 and an end portion of a left side of the extension pipe screw 5. In the embodiment, the coupling 7, the coupling shaft 8, and the gear train 9 constitute a connecting member which drivingly connects the main pipe screw 4 to the extension pipe screw 5. Further, in the embodiment, the coupling 7 constitutes a first driving transmission portion which is coupled to the main pipe screw 4, and the coupling shaft 8 and the gear train 9 constitute a second driving transmission portion which is dismountably connected to the first driving transmission portion described above. The coupling shaft 8 and the gear train 9 are held by the extension pipe 3 and dismountable from the main assembly 200 together with the extension pipe 3. In this way, it is furthermore easy to disassemble the collected toner conveying passage 10.

By the constitution described above, it is possible to transmit the driving of the main pipe screw 4 to the extension pipe screw 5. That is, it is not necessary to provide separate driving sources for each of the main pipe screw 4 and the extension pipe screw 5, and it is possible to drive the main pipe screw 4 and the extension pipe screw 5 with a simple constitution. In this way, it is possible to achieve a lower cost, a reduction in the number of parts, and a miniaturization.

Incidentally, in the embodiment, specifications of each of the gears in the gear train 9 are set so as to increase a rotational speed of the extension pipe screw 5 relative to a rotational speed of the coupling shaft 8. In this way, with respect to a conveying direction of the collected toner, it is possible to make a conveying performance (an amount of the collected toner which is capable of being conveyed per unit time) of the collected toner in the extension pipe 3 at a downstream side to be higher than a conveying performance of the collected toner in the main pipe 2 at an upstream side. As a result, it is possible to prevent a clogging of the collected toner inside the collected toner conveying passage 10.

6. Rotation Direction of the Screw

Next, a positional relationship between the collected toner conveying passage 10 and the fixing device 150, and a direction of rotation of the screw will be described. FIG. 11 is a front view showing the positional relationship between the collected toner conveying passage 10 and the fixing device 150. FIG. 12 is a sectional view along line B-B in FIG. 11.

As shown in FIG. 11, in the embodiment, the fixing device 150 is arranged below and in front of the main pipe 2 and the extension pipe 3. The fixing device 150, which is provided with the image forming portion 101, is an example of a heating portion which heats the recording material S on which an image is formed with a developer. In more detail, in the embodiment, the fixing device 150 is arranged below and in front of the main pipe 2 and the extension pipe 3 in a vicinity of a right side of the conveying passage connection portion 11. The fixing device 150 generates heat to heat the recording material S on which a toner image is transferred. Thus, the main pipe 2 and the extension pipe 3 are affected by heat from a direction where the fixing device 150 is arranged. That is, as shown in FIG. 12, when viewed from an upstream side of a conveying direction of the collected toner along a rotational axis of the main pipe screw 4 and the extension pipe screw 5, the main pipe 2 and the extension pipe 3 are affected by heat from a lower left direction which is indicated by an arrow D. Incidentally, in the embodiment, a rotational axial direction of the main pipe screw 4 and the rotational axial direction of the extension pipe screw 5 are substantially parallel.

In the embodiment, as shown in FIG. 12, when viewed from an upstream side of the conveying direction of the collected toner along the rotational axis of the main pipe screw 4, the main pipe screw 4 rotates in a counterclockwise direction as indicated by an arrow E. Further, in the embodiment, as shown in FIG. 12, when viewed from an upstream side of the conveying direction of the collected toner along the rotational axis of the extension pipe screw 5, the extension pipe screw 5 rotates in a counterclockwise direction as indicated by an arrow F. That is, when viewed from the upstream side of the conveying direction of the collected toner, the main pipe screw 4 and the extension pipe screw 5 rotate so that a direction of movement of the screw, on a side where the fixing device 150 is arranged with respect to a right to left direction, is from upward to downward. In this example, specifically, the gear train 9 is configured so that the direction of rotation of the main pipe screw 4 and the direction of rotation of the extension pipe screw 5 are as described above. In this way, the collected toner is conveyed inside the main pipe 2 and the extension pipe 3, while leaning in a direction toward a rear surface of the image forming apparatus 100. That is, the collected toner is conveyed inside the main pipe 2 and the extension pipe 3, while leaning in a direction away from the fixing device 150. Thus, it is possible to reduce a temperature change of the toner inside the main pipe 2 and the extension pipe 3, and to convey the collected toner consistently.

Incidentally, in the embodiment, the main pipe 2 and the extension pipe 3 are arranged in a rear side of the main assembly 200. Consequently, when viewed from the upstream side of the conveying direction of the collected toner along the rotational axis of the main pipe screw 4 and the extension pipe screw 5, the fixing device 150 is arranged in a position shifted to a left of the main pipe 2 and the extension pipe 3. In this case, when viewed in the direction, the main pipe screw 4 and the extension pipe screw 5 rotate counterclockwise as described above, and then the toner inside the main pipe 2 and the extension pipe 3 is conveyed while leaning in a direction away from the fixing device 150. In contrast, the main pipe 2 and the extension pipe 3 may be arranged, for example, in a front side of the main assembly 200. In this case, when viewed from the upstream side of the conveying direction of the collected toner along the rotational axis of the main pipe screw 4 and the extension pipe screw 5, the fixing device 150 may be arranged in a position shifted to a right side of the main pipe 2 and the extension pipe 3. And in this case, when viewed in the direction, the main pipe screw 4 and the extension pipe screw 5 rotate clockwise, and then the toner inside the main pipe 2 and the extension pipe 3 is conveyed while leaning in a direction away from the fixing device 150.

Further, in the embodiment, rotational directions of both the main pipe screw 4 and the extension pipe screw 5 are specified as described above, in order to stabilize a conveyance of the collected toner, as for both the main pipe 2 and the extension pipe 3. However, by specifying at least one of the rotational directions of the main pipe screw 4 and the extension pipe screw 5 as described above, it is possible to obtain a certain effect.

7. Effect

As described above, the image forming apparatus 100 of the embodiment includes the first casing 200, the second casing 300 which is detachably connected to the first casing 200, the image forming portion 101 which forms images using the developer, the collected toner conveying passage 10 which conveys the developer which is discharged from the image forming portion 101, and a container arrangement portion 301 in which the collecting container 102 which accommodates the developer conveyed via the collected toner conveying passage 10 is arranged. And in the embodiment, the image forming portion 101 is provided inside the first casing 200, the container arrangement portion 301 is provided inside the second casing 300, the collected toner conveying passage 10 is provided with the first conveying passage 2 which conveys the developer discharged from the image forming portion 101 inside the first casing 200, and the second conveying passage 3 which conveys the developer delivered from the first conveying passage 2 at the delivering portion 11 arranged inside the first casing 200 toward the collecting container 102 arranged in the container arrangement portion 301, and the second conveying passage 3 is detachably fixed to the side portion 201 of the first casing 200 which is exposed and accessible from outside of the first casing 200 by removing the second casing 300 from the first casing 200, and it is possible to remove the second conveying passage 3 by removing the second casing 300 from the first casing 200. The second conveying passage 3 may be fixed to the first casing 200 via the holding portion 35 which is either formed integrally with the second conveying passage 3 or to which the second conveying passage 3 is detachably attached. Further, in the embodiment, the first conveying passage 2 and the second conveying passage 3 are fixed to a same support member 202 which is provided with the first casing 200. In particular, in the embodiment, the support member 202 is a frame which is provided with the first casing 200 and to which at least a part of the image forming portion 101 is attached. Further, in the embodiment, the first conveying passage 2 and the second conveying passage 3 are not directly fixed to each other.

Further, in the embodiment, the image forming apparatus 100 includes the driving member 6, the first conveying member 4 which is arranged inside the first conveying passage 2, the second conveying member 5 which is arranged inside the second conveying passage 3, and connecting members 7, 8, and 9 which drivingly connect the first conveying member 4 and the second conveying member 5, the first conveying member 4 rotates by receiving a power from the driving member 6, and the second conveying member 5 rotates by receiving a power from the first conveying member 4 via the connecting members 7, 8, and 9. In the embodiment, the connecting members 7, 8, and 9 comprise the first driving transmission portion (7) which is coupled to the first conveying member 4, and the second driving transmission portions (8 and 9) which are detachably connected to the first driving transmission portion 7, and the second driving transmission portions 8 and 9 are held by the second conveying passage 3 and dismountable from the first casing 200 along with the second conveying passage 3. Further, in the embodiment, the image forming portion 101 includes the heating portion 150 which heats the recording material S on which an image is formed with the developer, the first conveying member 4 includes a first screw rotating around a first rotational axis, and when viewed from an upstream side of a conveying direction of the developer by the first screw along the first rotational axis, the heating portion 150 is arranged at a position shifted to a left or right side of the first conveying passage 2, and the first screw rotates in a direction in which the developer inside the first conveying passage 2 is conveyed while leaning in a direction away from the heating portion 150. Further, in the embodiment, the second conveying member 5 includes a second screw rotating around a second rotational axis, and when viewed from an upstream side of a conveying direction of the developer by the second screw along the second rotational axis, the heating portion 150 is arranged at a position shifted to a left or right side of the second conveying passage 3, and the second screw rotates in a direction in which the developer inside the second conveying passage 3 is conveyed while leaning in a direction away from the heating portion 150.

In this way, in the embodiment, the collected toner conveying passage 10 is constituted of the main pipe 2 and the extension pipe 3. And the extension pipe 3 is constituted to fix to the side portion 201 of the main assembly 200 which is exposed when the extension casing 300 is removed from the main assembly 200. In this way, it is possible to easily disassemble the collected toner conveying passage 10 and easily downsize the image forming apparatus 100. Thus, a workability of downsizing during carrying the image forming apparatus 100 is improved. That is, in the image forming apparatus 100 in which the collected toner conveying passage 10 is formed so as to cross between the first casing 200 and the second casing 300, it is possible to facilitate a downsizing work which involves a separation of the main assembly 200 and the extension casing 300.

OTHERS

So far, the present invention has been described according to the specific embodiments, however, the present invention is not limited to the embodiments described above, and it is possible to transform and change variously within a scope of the outline.

In the embodiment described above, when the image forming apparatus is viewed from a front side, the extension casing (second body, second casing) is connected to a left side of the main assembly (first body, first casing), however, the present invention is not limited to this, for example, it may be connected to a right side of the main assembly (first body).

Further, in the embodiments described above, a case where the conveying mechanism conveys the collected toner which is discharged from the cleaning device is described as an example, however, a developer which is conveyed by the conveying mechanism may be a developer which is discharged from the developing device. In the developing device which uses a two-component developer with a toner (non-magnetic toner particle) and a carrier (magnetic carrier particle) as a developer, there is a constitution in which the carrier is refilled in the developing device along with the toner and the developer containing mainly deteriorated carrier is gradually discharged from the developing device. In such a constitution, it is possible to convey the developer which is discharged from the developing device to the collecting container through a conveying mechanism of the same constitution as the embodiment described above.

Further, in the embodiment described above, the constitution is such that the collected toner conveying passage 10 is formed by the first conveying passage 2 and the second collected toner conveying passage 3, however, the conveying passage may be formed by a plurality of conveying passages including a third conveying passage other than the first conveying passage 2 and the second conveying passage 3. For example, the third conveying passage may be provided between the second conveying passage 3 and the collecting container 102.

According to the present invention, it is possible to provide an image forming apparatus which facilitate the downsizing work involving separation of the first body and the second body, in an image forming apparatus in which the conveying passage of the collected developer is formed to cross between the first body and the second body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a first body;

an image forming portion provided inside of said first body and configured to form a toner image;

a first conveying passage provided inside of said first body and configured to convey toner discharged from said image forming portion;

a second body detachably connected to said first body; and a second conveying passage configured to convey the toner received from said first conveying passage, wherein said second conveying passage is constituted to receive the toner from said first conveying passage in said first body, provided so as to be projected from said first body into said second body when said second body is connected to said first body, and constituted to be detachable from said first body while leaving said first conveying passage in said first body.

2. An image forming apparatus according to claim 1, wherein said first conveying passage and said second conveying passage are fixed to the same supporting member provided on said first body.

3. An image forming apparatus according to claim 2, wherein said supporting member is provided on said first body and includes a frame to which at least part of said image forming portion is attached.

4. An image forming apparatus according to claim 1, wherein said second conveying passage is detachably fixed to a side surface exposed when detaching said second body from said first body.

5. An image forming apparatus according to claim 1, further comprising a holding portion configured to hold said second conveying passage, said holding portion being detachably fixed to said first body.

6. An image forming apparatus according to claim 1, wherein said first conveying passage and said second conveying passage are constituted not to be directly fixed to each other.

7. An image forming apparatus according to claim 1, further comprising a driving member, a first conveying member disposed inside of said first conveying passage, a second conveying member disposed inside of said second conveying passage, and a connecting member configured to operatively connect said first conveying member and said second conveying member, wherein said first conveying member rotates by receiving a driving force from said driving member and said second conveying member rotates by receiving the driving force from said first conveying member through said connecting member.

8. An image forming apparatus according to claim 7, wherein said connecting member includes a first drive transmitting portion connected to said first conveying member, and a second drive transmitting portion detachably connected to said first drive transmitting portion, and wherein said second drive transmitting portion is held by said second conveying passage and is detachable from said first body with said second conveying passage.

9. An image forming apparatus according to claim 7, wherein said image forming portion includes a heating portion configured to heat a recording material on which the toner image is formed, wherein said first conveying member includes a first screw rotating about a first rotational axis, wherein when viewed along the first rotational axis from an upstream side with respect to a conveying direction of said first screw, said heating portion is disposed at a position shifted in one direction with respect to a left and right direction of said first conveying passage and said first screw is constituted to rotate in a direction where the one direction side moves from upward to downward with respect to the left and right direction, wherein said second conveying member includes a second screw rotating about a second rotational axis, and wherein when viewed along the second rotational axis from an upstream side with respect to a conveying direction of said second screw, said heating portion is disposed at a position shifted in the one direction with respect to the left and right direction of said second conveying passage and said second screw is constituted to rotate in a direction where the one direction side moves from upward to downward with respect to the left and right direction.

* * * * *